US007761042B2

(12) United States Patent
Sato et al.

(10) Patent No.: US 7,761,042 B2
(45) Date of Patent: Jul. 20, 2010

(54) COLOR IMAGE FORMING APPARATUS

(75) Inventors: Yotaro Sato, Tokyo (JP); Takenobu Kimura, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 944 days.

(21) Appl. No.: 11/548,716

(22) Filed: Oct. 12, 2006

(65) Prior Publication Data

US 2007/0177910 A1 Aug. 2, 2007

(30) Foreign Application Priority Data

Jan. 27, 2006 (JP) ..... 2006-018740

(51) Int. Cl.
*G03G 15/16* (2006.01)

(52) U.S. Cl. ..... 399/296

(58) Field of Classification Search ..... 399/170, 399/171, 172, 296

See application file for complete search history.

(56) References Cited

U.S. PATENT DOCUMENTS

| | | | | |
|---|---|---|---|---|
| 5,933,182 | A * | 8/1999 | Appel | 347/234 |
| 5,987,283 | A * | 11/1999 | Zhao et al. | 399/237 |
| 6,895,204 | B2 * | 5/2005 | Shin | 399/296 |
| 2001/0010768 | A1 * | 8/2001 | Furuya et al. | 399/296 |

* cited by examiner

*Primary Examiner*—David M Gray
*Assistant Examiner*—Gregory H Curran
(74) *Attorney, Agent, or Firm*—Lucas & Mercanti, LLP

(57) ABSTRACT

There is described a color image forming apparatus for forming a color image onto a transfer material by superimposing a plurality of unicolor toner images. The apparatus includes an intermediate transfer member onto which the plurality of unicolor toner images are successively transferred in such a manner that the plurality of unicolor toner images superimpose with each other, so as to form a full color toner image on the intermediate transfer member and a discharge section, in which a potential of the side plate is set at a polarity opposite to that of the grid electrode.

6 Claims, 4 Drawing Sheets

COLOR IMAGE FORMING APPARATUS

This application is based on Japanese Patent Application NO. 2006-018740 filed on Jan. 27, 2006 in Japanese Patent Office, the entire content of which is hereby incorporated by reference.

BACKGROUND OF THE INVENTION

The present invention relates to a copier, a printer, a facsimile and an image forming apparatus employing the electro-photographic method and having the functions mentioned in the above, and specifically relates to a color image forming apparatus that is provided with an intermediate transfer member on which a plurality of unicolor images are overlapped on each other so as to form a full color toner image.

Well known has been a color image forming apparatus that employs the electro-photographic method in which a toner image formed on an image bearing member serving as a photoreceptor element is primarily transferred onto the intermediate transfer member, and then, the toner image transferred onto the intermediate transfer member is secondarily transferred onto a transfer material. In such a color image forming apparatus, unicolor toner images sequentially formed on the plurality of image bearing members and charged in a predetermined polarity are transferred onto the intermediate transfer member by employing the electrostatic actions in such a manner that the unicolor toner images are superimposed on each other, and then, the full color toner image formed on the intermediate transfer member is further transferred onto the transfer material by employing an electrostatic action.

Since it is possible for the color image forming apparatus employing the intermediate transfer member to superimpose the unicolor toner images formed on a single or a plurality of image bearing member(s) on the intermediate transfer member, such a color image forming apparatus has been widely applied as an color image forming apparatus to form full color images on the transfer material. In this type of color image forming apparatus, the unicolor toner images formed on a single or a plurality of image bearing member(s) are transferred onto the intermediate transfer member in such a manner that the unicolor toner images overlap each other, and then, the overlapping toner image formed on the intermediate transfer member is further transferred onto the transfer material by employing the electrostatic action.

Since an electrostatic charge amount per one toner particle is substantially uniform among plural toner particles, an electric potential of the toner layer residing on the intermediate transfer member varies depending on an amount of toner attached within a predetermined area. Accordingly, in this color image forming apparatus, within the overall toner image formed on the intermediate transfer member, an electrostatic charge potential of a partial area on which plural unicolor toner images overlap each other is greater than that of other partial areas on which only a single unicolor toner image exists. Further, for instance, when the overall toner image formed on the intermediate transfer member includes both a solid color area and a halftone color area, an electrostatic charge potential of the solid color area is greater than that of the halftone color area.

Further, variation of the electrostatic charge potential within the overall toner image after passing through a primary transferring section, at which the unicolor toner image is transferred from the image bearing member to the intermediate transfer member, sometimes would occur due to environmental factors.

When the electric potential of the toner image residing on the intermediate transfer member widely varies as mentioned in the above, various areas whose transferring characteristics are different from each other, coexist in the same toner image. Therefore, attempting to transfer such image areas, whose transferring characteristics differ from each other, onto the transfer material under the same transferring condition, various kinds of image defects are liable to occur at the time of the secondary transferring operation from the intermediate transfer member to the transfer material.

In recent years, the color imaging trend has proliferated in the field of copiers, printers, facsimiles and compound image forming apparatus combining the functions of the abovementioned apparatuses, and, as for the transferring process, the demands for producing high-quality images have been getting larger than ever, due to the progressing trend of employing the polymer toner and the micro particle toner. In addition, the trend of increased production of the image forming apparatuses has also progressed. To obtain excellent images while meeting such trends, it is necessary to compensate for the electric potential of the toner layer residing on the intermediate transfer member, which is liable to vary depending on a number of primary transferring operations and the environmental factors, so as to make it uniform over the toner layer and to improve the secondary transferring efficiency.

Patent Document 1 (Tokkaihei 10-274892, Japanese Non-Examined Patent Publication) sets forth the apparatus that is provided with a discharge section for making the electrostatic charge potential of the toner layer residing on the intermediate transfer member uniform, before transferring the toner image onto the transfer material.

Patent Document 2 (Tokkaihei 11-143255, Japanese Non-Examined Patent Publication) sets forth the apparatus in which the potential difference controlling section controls the power source of the discharge section as well as other power source of the secondary transferring section, so that the potential difference between the electric potential of the toner layer is made uniform by the discharge section, and the other electric potential of the secondary transferring section is kept substantially constant.

As mentioned in the foregoing, in the color image forming apparatus in which the unicolor toner images borne by a single or a plurality of image bearing member(s) are transferred onto the intermediate transfer member by the primary transferring section(s) in such a manner that the unicolor toner images overlap with each other, and then, the overlapping toner image borne by the intermediate transfer member is secondarily transferred from the intermediate transfer member onto the transfer material, since an amount of toner charge of the toner image formed on the intermediate transfer member is liable to vary depending on a number of primary transferring operations and ambient environmental factors, various kinds of image defects are liable to occur at the time of the secondary transferring operation from the intermediate transfer member to the transfer material.

The color image forming apparatus set forth in Patent Documents 1 and 2 (Tokkaihei 10-274892 and Tokkaihei 11-143255, both being Japanese Non-Examined Patent Publication) compensates for an electrostatic charge amount of toner upstream side of the secondary transferring section by employing a scorotron charger. In other words, this is a technology for evening the electrostatic charge amount of toner, primarily transferred onto the intermediate transfer member, by employing the corona discharging phenomenon, such as the AC discharging action, the DC discharging action, etc.

In the color image forming apparatus set forth in Patent Documents 1 and 2, the toner image is further charged in the operation for compensating for the electrostatic charge amount of toner. Namely, the toner image already charged at a negative polarity is further charged by applying the corona discharging operation caused by an electric current of negative polarity. According to this method, since the overall electrostatic charge potential is getting higher, the variations of the electrostatic charge amount of toner become relatively unnoticeable.

However, when charging the overall toner image in the manner as mentioned in the above, since the electrostatic charge potential of the toner image to be secondarily transferred is also getting higher, the transferring bias voltage, necessary for transferring the toner image, should also be higher than that in normal conditions. As a result, the operation for controlling the transferring bias voltage becomes difficult, and the problems of image defects, such as electrical destruction of the toner image, etc., would arise. Further, since the electronic current necessary for the transferring operation is getting greater, the transferring efficiency is also getting worse. Still further, although it is possible to lower the electrostatic charge amount of the overall toner image by developing the latent image with toner whose electrostatic charge amount is lowered in advance, there would arise another problem that the toner are scattered around the developing section.

To cope with the abovementioned problems, the present inventors have invented a novel process for making the electrostatic charge amount of the overall toner image uniform in such a manner that a part of the toner image having a higher electrostatic charge amount is lowered by employing a dischargeable bias voltage, instead of further charging the toner image.

However, when the total electrostatic charge amount of the overlapping toner image part, namely, the higher potential part, is lowered in order to make the electrostatic charge amount uniform over the toner image, the electrostatic charge amount of the lower potential part (on which a smaller amount of toner exists) is also discharged at the same time, possibly resulting in occurrence of image defects, such as roughness of the halftone image portions, etc.

For instance, when simply employing a strong discharging operation, although the sufficient discharging effect for the portions carrying large amount of toner can be achieved, the electric potential at the portions carrying the small amount of toner are also lowered. On the contrary, when the discharging operation is weak, it is impossible to decrease the potential value of potions carrying the large amount of toner to a desired value, resulting in a difficulty of satisfying both of the abovementioned factors at the same time. To prevent such the deficiency, a controlling operation employing a grid electrode becomes necessary.

On the other hand, for instance, when the discharging operation of the positive polarity is applied to the toner layer, having the negative electric charge, so as to lower the toner layer potential in the discharging section before secondary transfer, the polarity of a certain part of the toner layer would be reversed. At this time, by applying the negative electric potential to the grid electrode so as to control the electric potential of the toner layer, the positively charged toner are attracted to the grid electrode and attached to the grid electrode, due to the electric field generated between the grid electrode and the intermediate transfer member. When the grid electrode is contaminated with toner, the functional efficiency of the grid electrode is also deteriorated. This results in the degradation of the controllability for the electric potential of the toner layer, a decrease of the electric potential at the toner carrying areas and the occurrence of image defects, such as roughness of the halftone image potions, etc. Accordingly, it has been difficult to obtain stable controllability, due to the degradation of the durability.

SUMMARY OF THE INVENTION

To overcome the abovementioned drawbacks in conventional image-recording apparatus, it is an object of the present invention to provide a color image forming apparatus, in which an electric field, for preventing the toner charged in an opposite polarity from being attracted to the grid electrode, can be formed by setting the potential of the side plate at a polarity opposite to that of the grid electrode, in order to prevent the grid electrode from being contaminated with toner and to improve the durability of the grid electrode, and as a result, which makes it possible to obtain a high-quality secondary transfer image for a long time.

Accordingly, to overcome the cited shortcomings, the abovementioned object of the present invention can be attained by a color image forming apparatus described as follow.

A color image forming apparatus for forming a color image onto a transfer material by superimposing a plurality of unicolor toner images, comprising: a plurality of image bearing members to form the plurality of unicolor toner images on the plurality of image bearing members, respectively; a plurality of primary transferring sections that correspond to the plurality of image bearing members to transfer the plurality of unicolor toner images formed on the plurality of image bearing members onto an intermediate transfer member so as to superimpose the plurality of unicolor toner images and form a full color toner image on the intermediate transfer member; a secondary transferring section to transfer the full color toner image, formed on the intermediate transfer member, onto the transfer material; and a discharge section provided between the plurality of primary transferring sections and the secondary transferring section to apply a bias voltage onto the full color toner image formed on the intermediate transfer member; the discharging section being constituted by a scorotron discharger having a discharging electrode, a grid electrode and a side plates, wherein a first voltage having a polarity opposite to that of the full color toner image is applied to the discharging electrode, a second voltage having a polarity same as that of the full color toner image is applied to the grid electrode, and a third voltage having a polarity opposite to that of the full color toner image is applied to the side plate.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENT

Referring to the embodiment, the present invention will be detailed in the following. The scope of the present invention, however, is not limited to the embodiment described in the following.

<Color Image Forming Apparatus>

Figure 1:
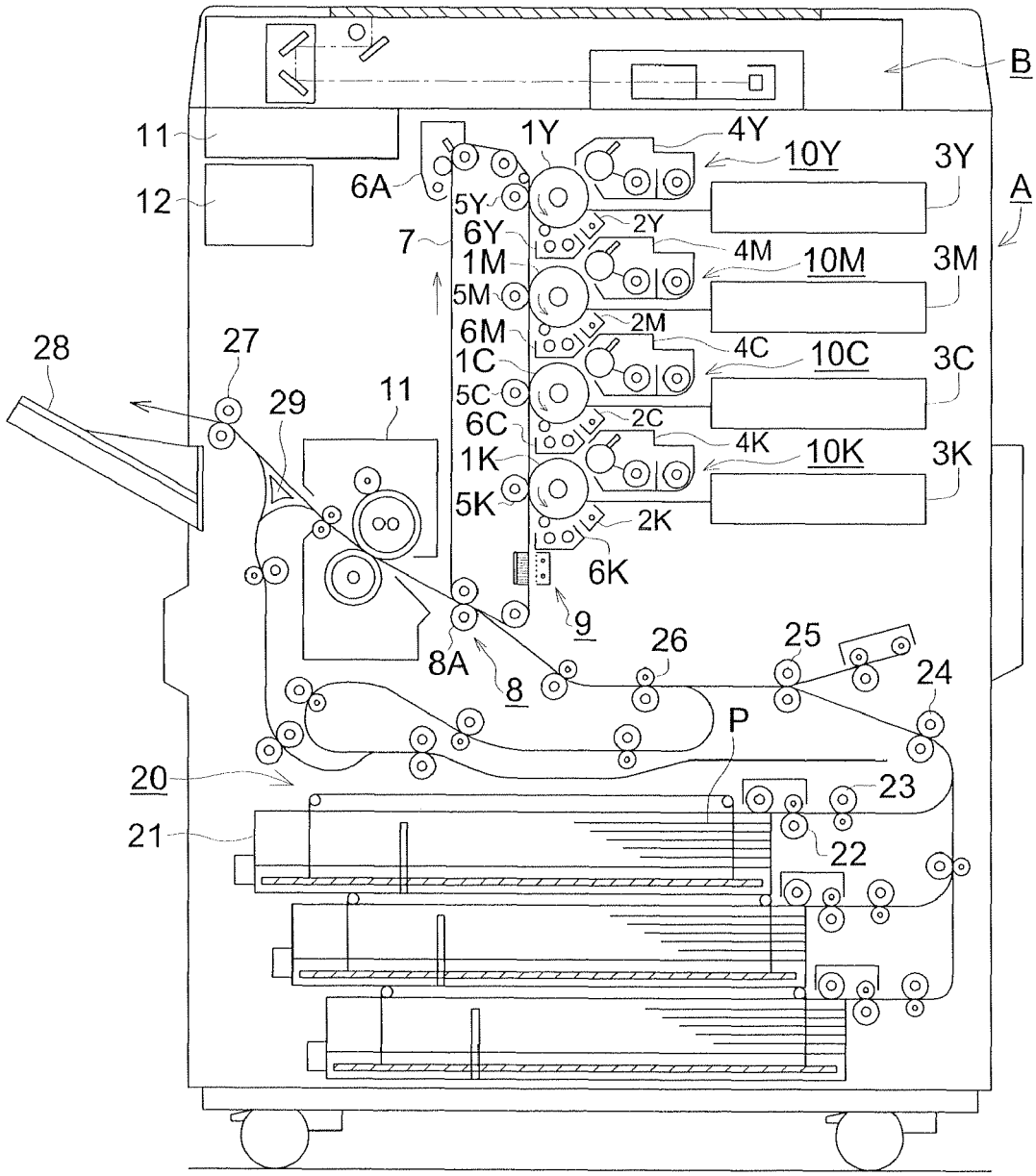
FIG. 1 shows a cross sectional view of an overall configuration of a color image forming apparatus embodied in the present invention.

FIG. 1 shows a cross sectional view of the overall configuration of a color image forming apparatus A embodied in the present invention.

The image forming apparatus A, called a tandem color image forming apparatus, is provided with a plural sets of image forming sections 10Y, 10M, 10C, 10K, a belt-type intermediate transfer member 7, primary transferring sections 5Y, 5M, 5C, 5K, a secondary transferring section 8, a (pre-secondary transfer) discharge section 9, a fixing device 11 and a paper feeding device 20.

An original image on a document, placed on a document placing plate located at an upper side of the image forming apparatus A, is read into a line image sensor via a scanning light beam, emitted from a document image scanning exposure device of the image reading device B, onto the original image of the document. Analogue image signals, acquired by photo-electronic converting actions performed in the line image sensor, are inputted into an image processing section, which applies an analogue processing, an analogue-to-digital conversion processing, a shading correction processing, an image compression processing, etc. to the analogue image signals, so as to generate processed digital image data. Then, the processed digital image data are inputted into exposure sections 3Y, 3M, 3C, 3K.

The image forming section 10Y for forming a unicolor image of color Y (Yellow) is provided with a charging section 2Y, the exposure section 3Y, a developing section 4Y and a cleaning section 6Y, which are disposed around an image bearing member 1Y.

The image forming section 10M for forming a unicolor image of color M (Magenta) is provided with a charging section 2M, the exposure section 3M, a developing section 4M and a cleaning section 6M, which are disposed around an image bearing member 1M.

The image forming section 10C for forming a unicolor image of color C (Cyan) is provided with a charging section 2C, the exposure section 3C, a developing section 4C and a cleaning section 6C, which are disposed around an image bearing member 1C.

The image forming section 10K for forming a unicolor image of color K (Black) is provided with a charging section 2K, the exposure section 3K, a developing section 4K and a cleaning section 6K, which are disposed around an image bearing member 1K.

Each combination of the charging section 2Y and the exposure section 3Y, the charging section 2M and the exposure section 3M, the charging section 2C and the exposure section 3C, and the charging section 2K and the exposure section 3K, constitutes a latent image forming section.

Although a well-known material, such as an OPC photosensitive material, an aSi (amorphous Silicon) photosensitive material, etc., can be employed for the image bearing members 1Y, 1M, 1C, 1K, the OPC photosensitive material is preferable. Specifically, the OPC photosensitive material having a negative charging property is preferable, and is employed in the present embodiment.

Although a corona discharger, such as a scorotron discharger, a corotron discharger, etc., can be employed for each of the charging sections 2Y, 2M, 2C, 2K, the scorotron discharger is preferably employed.

A light emitting element capable of emitting a light modulated according to the inputted digital image data, such as a laser emitting device, a LED (Light Emitting Diode) array, etc., is employed for each of the exposure sections 3Y, 3M, 3C, 3K.

The belt-type intermediate transfer member 7 has a semiconductive property and is threaded on a plurality of supporting rollers 71, 72, 73, 74 and a backup roller 75 so as to circulatably move along the image bearing member 1Y, 1M, 1C, 1K. In the present embodiment, the belt-type intermediate transfer member 7 is supported in a state of a flat plane at a section between the supporting rollers 73 and 74.

The unicolor images of colors Y, M, C, K respectively formed by the image forming sections 10Y, 10M, 10C, 10K are sequentially transferred one by one onto the belt-type intermediate transfer member 7, by the primary transferring sections 5Y, 5M, 5C, 5K (primary transferring operation), so as to form a full color image while the belt-type intermediate transfer member 7 circularly moves along the image forming sections 10Y, 10M, 10C, 10K.

A transfer material P, accommodated in a paper feeding cassette 21 of the paper feeding device 20, is picked up by a paper feeding roller 22, serving as a first paper feeding section, and is conveyed to the secondary transferring section 8 through paper feeding rollers 23, 24, 25 and a registration roller 26, serving as a second paper feeding section, so as to transfer the full color image onto the transfer material P (secondary transferring operation).

Then, a fixing device 11 applies heat and pressure onto the transfer material P, on which the full color image is already transferred, so as to fix the full color image (or a single color image) onto the transfer material P. Successively, the transfer material P having the fixed color image is ejected by an ejecting roller 27, and is stacked on an ejecting tray 28 disposed outside the apparatus.

On the other hand, after the full color image is transferred onto the transfer material P by the secondary transferring section 8 and the transfer material P is separated from the belt-type intermediate transfer member 7 by the curvature separating action, a cleaning section 6A removes the residual toner remaining on the belt-type intermediate transfer member 7.

<Primary Transferring Section>

Figure 2:
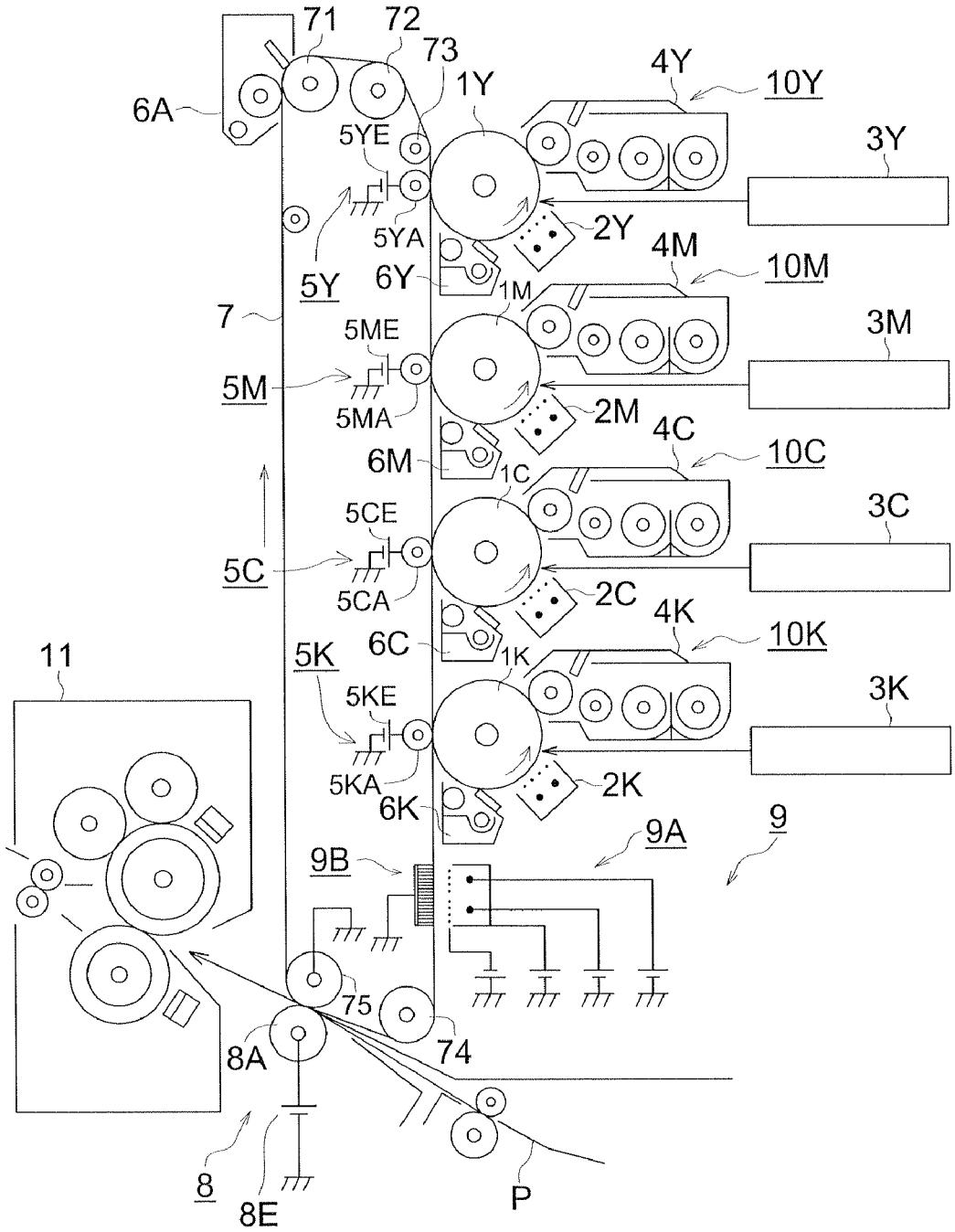
FIG. 2 shows a cross sectional view of a main part of an color image forming apparatus embodied in the present invention.

FIG. 2 shows a cross sectional view of the main part of the color image forming apparatus A.

The primary transferring section 5Y for transferring the unicolor image of color Y is constituted by a primary transferring roller 5YA and a power source 5YE for applying a voltage to the primary transferring roller 5YA. The primary transferring roller 5YA is disposed at such a position that opposes to the image bearing member 1Y while providing the belt-type intermediate transfer member 7 between them, so as to abrasively contact the inner surface of the belt-type intermediate transfer member 7. Further, the power source 5YE is coupled to the ground.

The primary transferring section 5M for transferring the unicolor image of color M is constituted by a primary transferring roller 5MA and a power source 5ME for applying a voltage to the primary transferring roller 5MA. The primary transferring roller 5MA is disposed at such a position that opposes to the image bearing member 1M while providing the belt-type intermediate transfer member 7 between them, so as to abrasively contact the inner surface of the belt-type intermediate transfer member 7. Further, the power source 5ME is coupled to the ground.

The primary transferring section 5C for transferring the unicolor image of color C is constituted by a primary transferring roller 5CA and a power source 5CE for applying a voltage to the primary transferring roller 5CA. The primary transferring roller 5C is disposed at such a position that opposes to the image bearing member 1C while providing the belt-type intermediate transfer member 7 between them, so as to abrasively contact the inner surface of the belt-type intermediate transfer member 7. Further, the power source 5CE is coupled to the ground.

The primary transferring section 5K for transferring the unicolor image of color K is constituted by a primary transferring roller 5KA and a power source 5KE for applying a voltage to the primary transferring roller 5KA. The primary transferring roller 5KA is disposed at such a position that opposes to the image bearing member 1K while providing the belt-type intermediate transfer member 7 between them, so as to abrasively contact the inner surface of the belt-type intermediate transfer member 7. Further, the power source 5KE is coupled to the ground.

Each of the power sources 5YE, 5ME, 5CE, 5KE applies the voltage of +1.5 kV and the electric current of 40 μA to each of the primary transferring sections 5Y, 5M, 5C, 5K.

Further, during the time other than the time of the primary transferring operation, the primary transferring sections 5Y, 5M, 5C, 5K are separated from the inner surface of the belt-type intermediate transfer member 7 by a driving section (not shown in the drawings), so as to place them at standby positions.

<Secondary Transferring Section 8>

The secondary transferring section 8 is constituted by the backup roller 75, a secondary transferring roller 8A, an electric power source 8E, etc. The backup roller 75, made of a conductive material, is disposed at a position opposing to the secondary transferring roller 8A while providing the belt-type intermediate transfer member 7 between them, and abrasively contact the inner surface of the belt-type intermediate transfer member 7.

The backup roller 75 is electrically coupled to the electric power source BE for applying a voltage onto the backup roller 75. The electric power source BE of the secondary transferring section 8 applies the voltage of +3 kV and the electric current of 50 μA to the backup roller 75. The residual toner attached to the secondary transferring roller 8A, contacting the belt-type intermediate transfer member 7, are transferred onto the belt-type intermediate transfer member 7 by applying the reverse bias voltage outputted from the electric power source 8E, so as to clean the secondary transferring roller 8A.

The backup roller 75, opposing to the secondary transferring roller 8A, has substantially the same structure as those of the primary transferring rollers 5YA, 5MA, 5CA, 5KA, and press-contacts the inner surface of the belt-type intermediate transfer member 7. The backup roller 75, being conductive, is constituted by a roller core body and an elastic layer, which is formed on the circumferential surface of the roller core body.

A single layer belt or a multi layer belt, made of polyamide, polyimide, etc., and having a volume resistivity of $10^7$-$10^{12}$ Ωcm is employed for the belt-type intermediate transfer member 7.

When the belt-type intermediate transfer member 7 passes through a cleaning device 6A after the secondary transferring section 8 transfers the toner image onto the transfer material P, the cleaning device 6A cleans the surface of the belt-type intermediate transfer member 7.

Further, during the time other than the time of the secondary transferring operation, the secondary transferring roller 8A is separated from the circumferential surface of the belt-type intermediate transfer member 7 by a driving section (not shown in the drawings), so as to place it at a standby position.

<Discharge Section 9>

In the color image forming apparatus employing the intermediate transferring method, there has been a problem that a high quality image can be hardly obtained in the secondary transferred color image due to a failure in the secondary transferring operation, even if the primary transferred color image could be formed in success due to the good primary transferring efficiency. This is because, the full color image formed on the belt-type intermediate transfer member 7 is constituted by a wide variety of attached toner amount in a range of one toner layer to four toner layers as maximum, and accordingly, the optimization of the secondary transferring conditions is not necessary uniform for such the wide variety of attached toner amount.

To overcome the problem mentioned in the above, the discharge section 9, embodied in the present invention, is disposed at a position at which the belt-type intermediate transfer member 7 is supported in a state of a flat plane located between the primary transferring section 5K and the supporting roller 74 along the belt-type intermediate transfer member 7.

Further, an opposing electrode 9B, made of a conductive brush, a conductive foaming material, etc., face-contacts the belt-type intermediate transfer member 7 to couple the belt-type intermediate transfer member 7 to the ground, so as to achieve an improvement of the discharging efficiency higher than ever.

The discharge section 9, embodied in the present invention, is constituted by a discharger 9A disposed at the image bearing side of the belt-type intermediate transfer member 7 and the opposing electrode 9B disposed at the inner side of the belt-type intermediate transfer member 7.

Figure 3:
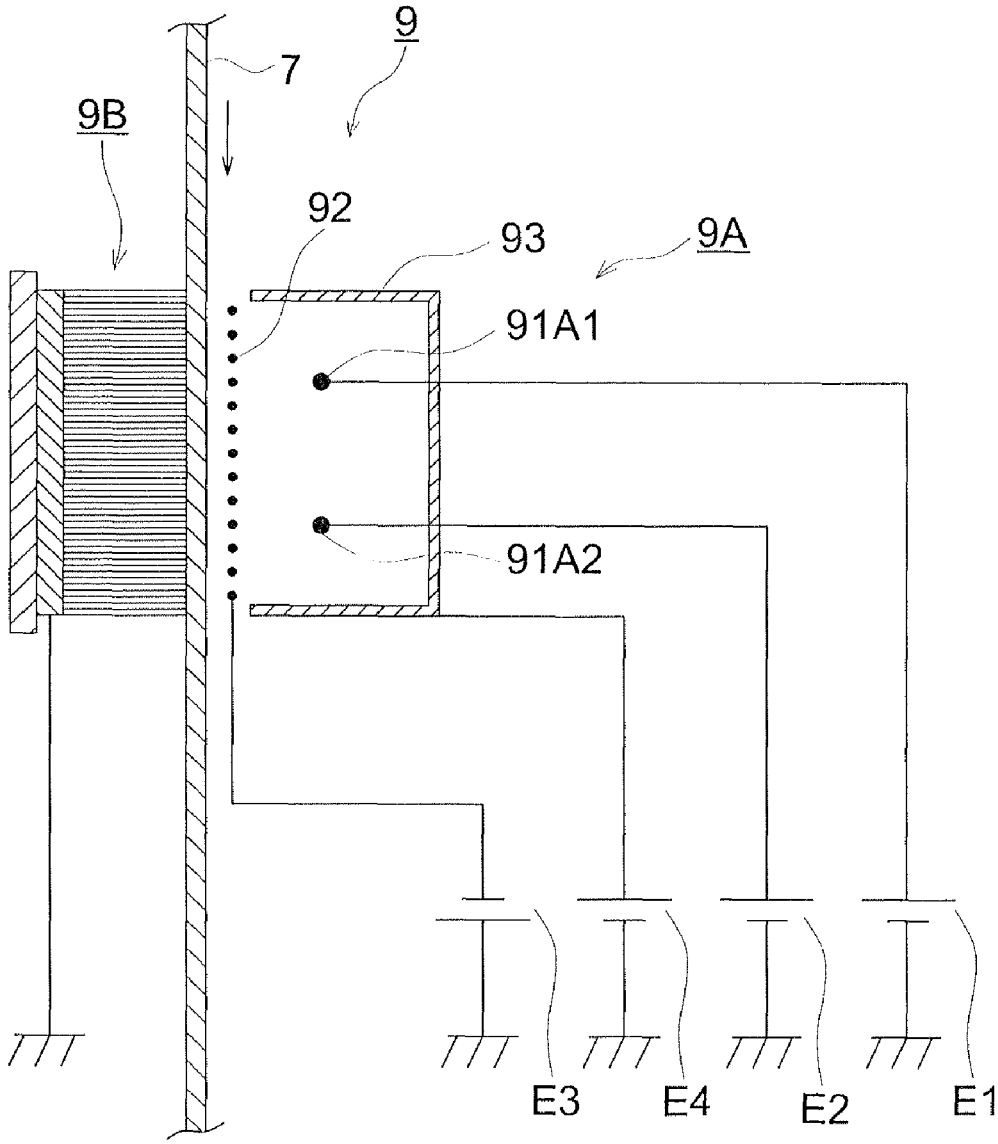
FIG. 3 shows a cross sectional view of a discharge section, embodied in the present invention.

FIG. 3 shows a cross sectional view of the discharge section 9, embodied in the present invention.

The discharger 9A, disposed at a upstream side in the moving direction of the belt-type intermediate transfer member 7, is a scorotron charger including discharging electrodes 91A1, 91A2, a grid electrode 92 and a side plate 93.

As shown in FIG. 3, the discharging electrode 91A1 is coupled to a power source E1, while the discharging electrode 91A2 is coupled to a power source E2. The grid electrode 92 is disposed at a position opposing to the circumferential surface of the belt-type intermediate transfer member 7 with a gap, and is coupled to a power source E3. The side plate 93 is coupled to a power source E4.

A voltage for activating a discharging action in a polarity opposite to that of the toner image is applied to each of the discharging electrodes 91A1, 91A2. A voltage having a polarity same as that of the toner image is applied to the grid electrode 92. Further, a voltage for activating a discharging action in a polarity opposite to that of the toner image is applied to the side plate 93.

The opposing electrode 9B including a conductive brush, which is mechanically coupled to a press-contact release mechanism (not shown in the drawings) for press-contacting and releasing the conductive brush to/from the belt-type intermediate transfer member 7, is disposed at inner side of the belt-type intermediate transfer member 7, so as to oppose to the discharge section 9. The conductive brush abrasively contacts the inner side of the belt-type intermediate transfer member 7, and is electrically coupled to the ground.

EXAMPLES

Concrete examples of the present invention will be detailed in the following. However, the scope of the present invention is not limited to the following examples.

<Image Forming Conditions>

Figure 4:
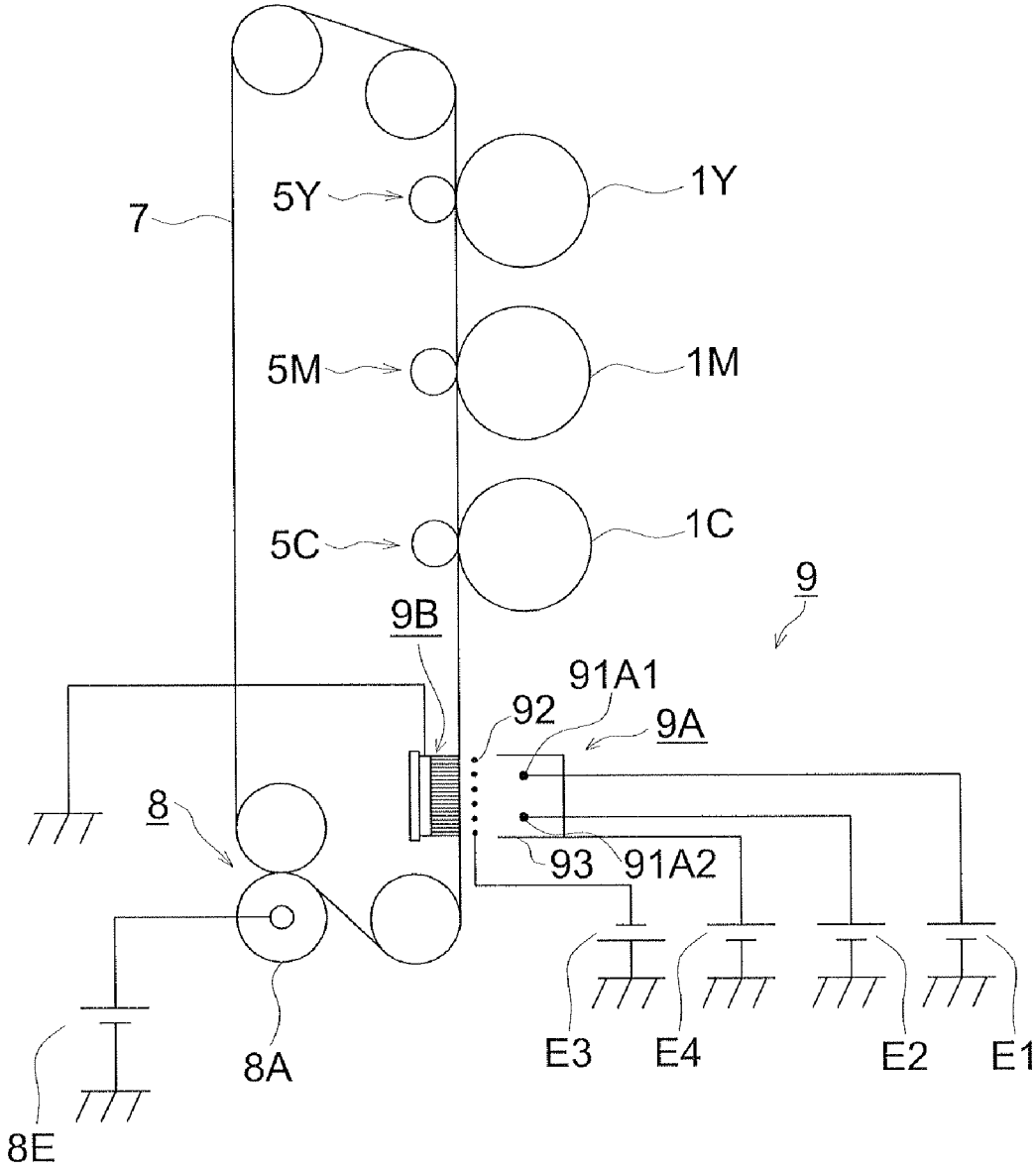
FIG. 4 shows a schematic diagram of a main part of a modified full color copier.

IMAGE FORMING APPARATUS: TANDEM-TYPE FULL COLOR COPIER (MODIFIED VERSION OF KONICAMINOLTA 8050 (TRADE MARK)), having a continuous copy speed of 51 sheets/minute for A4 size sheet in the full color copy mode FIG. 4 shows a schematic diagram of the main part of the modified full color copier.

In order to confirm the effects of the present invention, the color image forming apparatus A, in which the primary transferring sections 5Y, 5M, 5C, 5K and the secondary transferring section 8, shown in FIG. 2, were equipped, while the image bearing member 1K, the charging section 2K, the developing section 4K and the cleaning section 6K disposed in the image forming section 10K, serving as a fourth image forming stage, were removed, and the discharge section 9 embodied in the present invention was equipped therein instead of the image forming section 10K, was employed for forming images as the present embodiment.

Image bearing members 1Y, 1M, 1C: outer diameter ϕ; 60 mm

Conveyance line velocity of the transfer material P: 220 mm/sec

Developer: average particle diameter of carrier; 20-60 μm, average particle diameter of polymerization toner; 3-7 μm Charging sections 2Y, 2M, 2C: charge voltage; −700 V Exposure sections 3Y, 3M, 3C: wavelength of semiconductor laser; 780 nm, surface potential of photoreceptor member at the time of exposure; −50 V Developing sections 4Y, 4M, 4C: electric potential Vdc of developing sleeve; −500 V, developing bias alternate voltage component Vac; 1 kVp-p rectangular waveform (frequency: 5 kHz)

Primary transferring rollers 5YA, 5MA, 5CA: conductive roller is employed, roller pressure; 50 N (Newton), transferring current: 40 μA, applied transferring voltage; +1.5 kV Secondary transferring section 8: having a structure in which the backup roller 75 presses the secondary transferring roller 8A while providing the belt-type intermediate transfer member 7 between them, resistivity of both of them; $1\times10^7$ Ω, applying a predetermined current value selected from Table of current values in a matrix of temperature/humidity and counter Pressing pressure: 50 N (Newton)

Nip width in a conveying direction of transfer material: 3 mm

Elastic layer of secondary transferring roller 8A: semi-conductive NBR solid rubber (acrylonitrile-butadiene rubber), volume resistivity; $4\times10^7$ Ω, outer diameter ϕ; 40 mm Belt-type intermediate transfer member 7: polyimide resin, seamless semi-conductive belt (volume resistivity; $4\times10^9$ Ωcm), threading tension; 50 N, line velocity; 220 mm/sec <Discharge Section 9>

The discharger 9A having the same shape as that of the scorotron charger, which is normally employed for the image bearing member, is equipped in the apparatus concerned.

A wire rod material, made of a tungsten, a stainless steel, a gold, etc., having a diameter in a range of 20-150 μm can be employed for the discharging electrodes 91A1, 91A2, and specifically, it is preferable that the surface of the wire rod material is coated with a gold. It is applicable either to manufacture the wire rod material itself made of solid gold or to coat the surface of a core metal of the wire rod material, made of tungsten, stainless steel, etc., with gold. In view of the removing efficiency of the discharge creating products, such as ozone gas, etc., the manufacturing cost and the discharging efficiency, it is preferable that the thickness of the coated gold layer is in a range of 1-5 μm as an average film thickness.

Any one of a wire-type grid made of wires, a plate-type grid on which a grid pattern is formed by applying an etching treatment, etc., a plate-type grid on which a gold plating treatment is applied, etc., can be employed for the grid electrode 92.

The discharging electrodes 91A1, 91A2 are coupled to the power source E1 of high voltage and the power source E2 of high voltage, respectively, so as to apply electric currents in a range of 0-400 μA to the discharging electrodes 91A1, 91A2. The grid electrode 92 is coupled to the power source E3 of high voltage, so as to apply electric currents in a range of 0--300 μA to the grid electrode 92. The side plate 93 is insulated from the grid electrode 92, and is so constituted that a voltage in a range of 50-300 V can be applied to the side plate 93. Further, the opposing electrode 9B disposed opposite to the discharger 9A is coupled to the ground.

The discharger 9A is so constituted that a voltage V1 for activating a discharging action in a polarity opposite to that of the toner image, a voltage V2 for activating a discharging action in a polarity opposite to that of the toner image and a voltage V3 having a polarity same as that of the toner image, can be applied to the discharging electrodes 91A1, 91A2 and the grid electrode 92, respectively.

In the present embodiment, the discharger 9A is so constituted that a voltage for activating a discharging action in a polarity opposite to that of the toner image and a voltage having a polarity same as that of the toner image can be applied to the discharging electrodes 91A1, 91A2 and the grid electrode 92, respectively In this example, corresponding to the toner image having a negative charge, a voltage having a positive polarity is applied to the discharging electrodes 91A1, 91A2 of the discharge section 9, while a voltage having a negative polarity is applied to the grid electrode 92 and a voltage having a positive polarity is applied to the side plate 93.

The grid electrode 92 and the belt-type intermediate transfer member 7 are disposed in parallel with a gap of 1 mm.

The distance between the discharging electrodes 91A1, 91A2 (the interval of them in the moving direction of the belt-type intermediate transfer member 7) is set at 30 mm, while the length in a longitudinal direction of the discharging electrodes 91A1, 91A2 (the length in the direction orthogonal to the moving direction of the belt-type intermediate transfer member 7) is set at 320 mm.

The electric current value supplied from the power sources E1, E2 to the discharging electrodes 91A1, 91A2 is set at 350 μA, the distance between the discharging electrodes 91A1, 91A2 and the grid electrode 92 is set at 8 mm, and the distance between the discharging electrodes 91A1, 91A2 and the side plate 93 is set at 8 mm. The aperture of the grid electrode 92 is 90%, while the electric potential of the opposing electrode 9B is 0 V.

The opposing electrode 9B including a conductive brush, which is mechanically coupled to a press-contact release mechanism (not shown in the drawings) for press-contacting and releasing the conductive brush to/from the belt-type intermediate transfer member 7, is disposed at inner side of the belt-type intermediate transfer member 7, so as to oppose to the discharger 9A.

It is desirable that the conductive brush is made of a conductive resin material, such as an acrylic, a nylon, a polyester, etc., and has specifications indicated as follow.

Diameter of each fiber: 0.11-0.778 tex (in the metric unit of the yarn count method proposed by ISO)

Brush density: 12000-77000 fibers/$cm^2$

Resistivity of original fiber: $10^0$-$10^5$ Ωcm

The conductive brush employed in this example has the specification indicated as follow.

Resistivity of original fiber: $10^2$ Ωcm

Diameter of each fiber: 3 denier (a degree of fineness at a length of 4560 m and a mass of 50 mg is defined as 1 denier)

Density: 200 kF/$inch^2$ (F is a number of filaments, 1 inch is 25.4 mm)

Fiber length: 3 mm

The width of the conductive brush of the opposing electrode 9B (namely, its length in the moving direction of the belt-type intermediate transfer member 7) is set at 30 mm, while the length of the conductive brush in its longitudinal direction (namely, its length in the direction orthogonal to the moving direction of the belt-type intermediate transfer member 7) is set at 320 mm.

Examples and Comparative Examples

An electric potential Vs of the side plate 93 of the discharge section 9 (hereinafter, referred to as a side plate potential Vs, for simplicity) of the example 1, embodied in the present invention, is set at a positive high voltage of 950 V, the side plate potential Vs of the example 2 is set at a positive middle voltage of 300 V and the side plate potential Vs of the example 3 is set at a positive low voltage of 50 V, respectively.

The side plate potential Vs of the comparative example 1 is set at a negative low voltage of −50 V, while the side plate potential Vs of the comparative example 2 is set at a negative high voltage of −550 V.

Incidentally, in the examples and the comparative examples mentioned in the above, the electric current flowing into each of the discharging electrodes 91A1, 91A2 is set at 350 μA, a grid electric potential Vg is set at −50 V and the electric potential of opposing electrode 9B is set at 0 V.

Accordingly, the absolute value of the electric potential Vg of the grid electrode 92 (hereinafter, referred to as the grid electric potential Vg) and the absolute value of the side plate potential Vs fulfill the relationship indicated as follow.

$$|Vg| \leqq |Vs|$$

In order to confirm the effects of the present invention, the electric potentials of toner layers before and after the discharge operation, image qualities of blue color solid images formed by superimposing cyan toner over magenta toner under the environment of low temperature and low humidity (hereinafter, referred to as the LL environment), and image qualities of halftone images formed by a single layer of cyan color, were confirmed.

With respect to the examples 1, 2, 3 and the comparative example 1, 2, the results of confirming the image qualities were indicated in Table 1.

TABLE 1

| | Side plate potential Vs | Number of prints | Blue image under LL environment | Roughening of Halftone image |
|---|---|---|---|---|
| Example 1 | 950 V | Start time | Good | Good |
| | | After 5000 p | Good | Good |
| Example 2 | 300 V | Start time | Good | Good |
| | | After 5000 p | Good | Good |
| Example 3 | 50 V | Start time | Good | Good |
| | | After 5000 p | Good | Good |
| Comparative Example 1 | −50 V | Start time | Good | Good |
| | | After 5000 p | Good | Bad |
| Comparative Example 2 | −550 V | Start time | Good | Good |
| | | After 5000 p | Good | Bad |

As indicated in Table 1, with respect to the examples 1, 2, 3 and the comparative examples 1, 2, evaluations of the blue images under the LL environment and evaluations of roughening of the halftone images under the LL environment were conducted at the time of starting the printing operation and after 5000 prints were printed.

In the evaluation items of the blue image shown in Table. 1, "Good" indicates such a state that the electric potential of the toner layer is lowered to 100 v by the discharging action conducted by the discharge section 9, and as a result, the blue image having a uniform density without generating any image unevenness can be obtained.

In the evaluation items of the roughening shown in Table. 1, "Good" indicates such a state that the electric potential of the toner layer of the halftone image is not affected by the discharging action conducted by the discharge section transfer 9, and as a result, the halftone image having a uniform density without generating any image unevenness can be obtained.

In the evaluation items of the roughening shown in Table. 1, "Bad" indicates such a state that the electric potential of the toner layer of the halftone image is also discharged, and as a result, an unpolished feeling, an image roughness and/or a lack of density uniformity are recognized in the halftone image.

In the examples 1, 2, 3 embodied in the present invention, in each of which the side plate potential Vs having a polarity opposite to the electric potential of the toner image is applied, the blue color solid images, formed by superimposing cyan toner over magenta toner under the LL environment, can be obtained as the blue images having a uniform density without generating any image unevenness. Further, since little amount of toner was attached to the grid electrode 92 even after 5000 images are printed, it becomes possible to obtain halftone images having uniform density without generating any image unevenness in the halftone images of the single cyan toner layer.

In the comparative examples 1, 2, although the blue images formed under the LL environment, and the blue images and the halftone images at the time of starting the print operation are evaluated as "Good", a considerable amount of toner attached to the grid electrode 92 after 5000 prints are printed causes roughening of the halftone images.

As mentioned in the foregoing, according to the examples embodied in the present invention, since the contamination of the grid electrode, caused by the toner charged in a reversed polarity and generated in the discharging operation, can be prevented, it becomes possible to obtain images (halftone images) having uniform density without generating any image unevenness in the images. In addition, the abovementioned effect can be obtained over a long time image-forming operation, resulting in an achievement of the stable discharging efficiency superior in the durability.

Further, it becomes possible to lower the total charge amount at a part of overlapping toner image, namely, a high electric potential area, while it also becomes possible to prevent an excessive decrease of an electric potential at an area attached with a small amount of toner, such as the halftone area, etc. As a result, with respect to a color image, it becomes possible to prevent the roughening of an image area at which a small amount of toner is attached, and it also becomes possible to obtain a good secondary transferring efficiency for the overlapping toner image.

Incidentally, although an example of the image forming apparatus in which the belt-type intermediate transfer member 7 is employed for the intermediate transfer member has been described as an embodiment of the present invention in the foregoing, it is needless to say that another type of the intermediate transfer member (for instance, a drum-type intermediate transfer member) can be also employed for the intermediate transfer member in the image forming apparatus embodied in the present invention.

While the preferred embodiments of the present invention have been described using specific term, such description is for illustrative purpose only, and it is to be understood that changes and variations may be made without departing from the spirit and scope of the appended claims.

What is claimed is:

1. A color image forming apparatus for forming a color image onto a transfer material by superimposing a plurality of unicolor toner images, comprising:

a plurality of image bearing members to form the plurality of unicolor toner images on the plurality of image bearing members, respectively;

a plurality of primary transferring sections that correspond to the plurality of image bearing members to transfer the plurality of unicolor toner images formed on the plurality of image bearing members onto an intermediate transfer member so as to superimpose the plurality of unicolor toner images with each other to form a full color toner image on the intermediate transfer member;

a secondary transferring section to transfer the full color toner image, formed on the intermediate transfer member, onto the transfer material; and a discharge section disposed at such a position that is located between the plurality of primary transferring sections and the secondary transferring section and opposite to the intermediate transfer member, to apply a bias voltage onto the full color toner image formed on the intermediate transfer member;

wherein the discharge section is constituted by a scorotron discharger including a discharging electrode, a grid electrode and a side plate, which are disposed in such a manner that the grid electrode is inserted into a gap formed between the discharging electrode, which is partially enclosed by the side plate, and the intermediate transfer member; and wherein a first voltage having a polarity opposite to that of the full color toner image is applied to the discharging electrode, a second voltage having a polarity same as that of the full color toner image is applied to the grid electrode, and a third voltage having a polarity opposite to that of the full color toner image is applied to the side plate.

2. The color image forming apparatus of claim 1, further comprising:

an opposing electrode that is disposed opposite to the scorotron discharger so that the intermediate transfer member is located between the opposing electrode and the scorotron discharger.

3. The color image forming apparatus of claim 2, wherein the opposing electrode is mounted in such a manner that the opposing electrode face-contacts the intermediate transfer member.

4. The color image forming apparatus of claim 1, wherein the discharge section is disposed at the position at which the intermediate transfer member is supported in a state of a flat plane.

5. The color image forming apparatus of claim 4, wherein the intermediate transfer member is shaped in an endless belt.

6. The color image forming apparatus of claim 5, further comprising:

a plurality of supporting rollers;

wherein the intermediate transfer member is supported in a state of the flat plane at a section between the pluralities of supporting rollers.

* * * * *